US007495639B2

(12) United States Patent
Chang

(10) Patent No.: US 7,495,639 B2
(45) Date of Patent: Feb. 24, 2009

(54) DRIVING METHOD OF LIGHT EMITTING DIODE

(75) Inventor: Shih-Ting Chang, Taoyuan (TW)

(73) Assignee: Holtek Semiconductor Inc., Hsinchu (TW)

( * ) Notice: Subject to any disclaimer, the term of this patent is extended or adjusted under 35 U.S.C. 154(b) by 363 days.

(21) Appl. No.: 11/095,578

(22) Filed: Apr. 1, 2005

(65) Prior Publication Data

US 2006/0187157 A1 Aug. 24, 2006

(30) Foreign Application Priority Data

Feb. 22, 2005 (TW) ..... 94105157 A

(51) Int. Cl.
*G09G 3/32* (2006.01)

(52) U.S. Cl. ..... 345/82; 315/169.3

(58) Field of Classification Search ..... 345/76–83, 345/211–213; 315/169.1, 169.3; 340/815.45, 340/FOR. 282

See application file for complete search history.

(56) References Cited

U.S. PATENT DOCUMENTS

| | | | | |
|---|---|---|---|---|
| 6,366,116 | B1 | 4/2002 | Juang | 326/37 |
| 6,369,515 | B1 * | 4/2002 | Okuda | 315/169.3 |
| 6,501,226 | B2 | 12/2002 | Lai et al. | 315/169.1 |
| 6,608,448 | B2 * | 8/2003 | Boer | 315/169.3 |
| 6,650,308 | B2 * | 11/2003 | Kawashima | 345/76 |
| 6,686,898 | B2 | 2/2004 | Chen et al. | 345/82 |
| 2005/0007321 | A1 * | 1/2005 | Schuler | 345/82 |

* cited by examiner

*Primary Examiner*—Bipin Shalwala
*Assistant Examiner*—Kenneth B Lee, Jr.
(74) *Attorney, Agent, or Firm*—WPAT. P.C.; Justin King

(57) ABSTRACT

A power-saving and efficient driving method for driving a matrix of light emitting diodes arrayed in rows and columns. The method comprises the steps of: (A) executing the phases of Dis-Charge, Pre-Charge, Current On and Dis-Charge in successive for an active column; (B) executing the phases of Dis-Charge, Floating, Dis-Charge and Dis-Charge in successive for a non-active column; (C) executing the phases of Current Sink, Current Sink, Current Sink and Current Sink in successive for an active row; and (D) executing the phases of Floating, Floating, Reverse Bias and Floating in successive for a non-active row.

3 Claims, 8 Drawing Sheets

(A)Active Column

| 51 | 52 | 53 | 54 |
|---|---|---|---|
| Dis-Charge | Pre-Chage | Current On | Dis-Charge |

(B)Non-Active Column

| 55 | 56 | 57 | 58 |
|---|---|---|---|
| Dis-Charge | Floating | Dis-Charge | Dis-Charge |

(C)Active Row

| 59 | 60 | 61 | 62 |
|---|---|---|---|
| Current Sink | Current Sink | Current Sink | Current Sink |

(D)Non-Active Row

| 63 | 64 | 65 | 66 |
|---|---|---|---|
| Floating | Floating | Reverse Bias | Floating |

FIG.4

States of C2-1,C3-1
before entering
Current on phase

States of C2-1,C3-1
after entering
Current on phase

DRIVING METHOD OF LIGHT EMITTING DIODE

FIELD OF THE INVENTION

The present invention relates to a power-saving and efficient method for sequentially driving light emitting diodes (LEDs) arranged in an array, and more particularly, to a driving method capable of optimizing the performance of a panel of passive-matrix LEDs by matching the phases of the corresponding rows and columns thereof as each row or column is selected to switch between the following phases: Dis-charge, Pre-Charge, Reverse Bias, Floating, Current On, and Current Sink.

BACKGROUND OF THE INVENTION

With the imaging appliance revolution underway along with the advance of electronic industry, the need for more advanced display devices is increasing and the flat-panel mobile display industry is searching for a display technology that will revolutionize the industry. The need for new light-weight, low-power, high brightness, and extensive endurance display devices has pushed the display industry to revisit the current flat-panel digital display technology. Compared with other display technologies, the LED display has the following advantages, such as self-luminescence, super-thin appearance, high brightness, high luminance efficiency, short response time, power saving, wide temperature tolerance, flexible panel, and so forth. Therefore, the LED display is believed to be the major trend of the display market for the coming generation.

Generally, it is common to drive an OLED display by using the row scan technology, which applies the three-phase driving method. As shown in FIG. 1A to FIG.1D, for each column, there are phases of Dis-charge, Pre-Charge, and Current On, and for each row, there are phases of Reverse Bias and Current Sink.

As seen in FIG. 1A, the successive phases of an active column are sequentially addressed as following:

- Dis-Charge phase 11: for eliminating the electricity previously stored on an LED of the active column;
- Pre-Charge phase 12: for compensating the parasitic capacitance of the LED so as to enable the LED to have a preferred initial value for the Current On phase 13 successive to the Pre-Charge phase 12; and
- Current On phase 13: for conducting electric current to the LED.

As seen in FIG. 1B, the successive phases of a non-active column are sequentially addressed as following: Dis-Charge phase 14; Dis-Charge phase 15; and Dis-Charge phase 16; during which the anodes of the LEDs of the non-active column are grounded since the LEDs are not to be activated.

As seen in FIG. 1C, the successive phases of an active row are sequentially addressed as following: Current Sink phase 17; Current Sink phase 18; and Current Sink phase 19; during which the cathode of the LEDs of the active row are grounded for conducting a forward bias current thereto.

As seen in FIG. 1D, the successive phases of a non-active row are sequentially addressed as following: Reverse Bias phase 20; Reverse Bias phase 21; and Reverse Bias phase 22; during which a reverse bias is provided to each of the LED of the non-active row for preventing the conducting of current and thus enabling the LEDs to endure longer operation.

FIG. 2A illustrates a schematic architecture of a panel of passive-matrix LEDs, which is adversely influenced by the effect of parasitic capacitance. As the panel of passive-matrix LEDs is first activated, the driver drives the passive-matrix LEDs to enter their first phase, i.e. the Dis-Charge phase for the active columns and non-active columns, and the same time that the columns S1~S4 are grounded while the row R1 is an active row and the rows R2 and R3 are non-active rows that are connected to a reverse potential of Vrev as seen in FIG. 2B. That is, at the moment shown in FIG. 2B, the rows R2 and R3 are not being scanned but still the LEDs of the two rows R2, R3 are being charged by the reverse potential of Vrev. In that the use of the reverse potential of Vrev is considered as a waste of energy for charging those non-active LEDs.

Assuming that the column S1 is an active column and the columns S2, S3 and S4 are non-active columns and all are driven to enter their second phase, which is shown in FIG. 2C, the column S1 is enabled to enter the Pre-Charge phase while the row R1 is grounded and the rows R2, R3 are connected to the reverse potential of Vrev. Therefore, the LED at the intersect of R1 and S1 is charged to a pre-charge potential of Vpre while the LEDs on the column S1 of rows other than R1 are also being charged, i.e. the Vpre connected to the column S1 also charges the capacitors of the LEDs at the intersect of R2, S1 and R3, S2, which are addressed as C2-1 and C3-1. However, since both the C2-1 and C3-1 have the reverse potential of Vrev, it requires a longer charging time or a higher voltage to complete the Pre-Charge phase, moreover, as the more the rows exist in the panel, the more sever the effect of parasitic capacitance such that the loading of the pre-charge circuit is increasing as to consume more power.

As the column S1 enters the Current On phase as shown in FIG. 2D, the column S1 acting as an active column is conducting a current to the panel of passive-matrix LEDs while the columns S2, S3 and S4 and the row R1 are still grounded and the rows R2, R3 are still connected to the reverse potential of Vrev. At the moment of the Current On phase that is capable of charging the capacitors of the column S11 to a potential of Vcon, if Vcon<=Vrev, the potentials of the C2-1 and C3-1 will be—(Vrev-Vcon) such that the potentials at the ends of R2 and R3, i.e. Vr2 and Vr3, are increased by charge pump effect enabling both Vr2 and Vr3 are larger than Vrev. Nevertheless, those surplus potentials will be discharged by the ESD protection diode installed in the driving circuit so that the potentials at the ends of R2 and R3 are recovered to Vrev. Thus, it is noted that the increasing of potential along with the successive ESD discharging is a waste of energy.

After the Current On phase is completed, the present scan duty is completed and the next scan duty is initiated that the row R2 is being scanned instead of the row R1, that is, the column S1, S2 and S3 and the row R2 are grounded while the rows R1, R3 are connected to Vrev, where the transition of a capacitor of the passive-matrix LED is shown successively in FIG. 3A, FIG. 3B and FIG. 3C. Similarly, the charge pump effect also causes energy waste in this next scan duty.

Form the above description, it is noted that an improvement to the conventional panel of passive-matrix LEDs is greatly required.

SUMMARY OF THE INVENTION

It is the primary object of the invention to provide a power-saving and efficient driving method capable of optimizing the performance of a panel of passive-matrix LEDs by matching the phases of the corresponding rows and columns thereof as each row or column is selected to switch between the following phases: Dis-charge, Pre-Charge, Reverse Bias, Floating, Current On, and Current Sink according to the distributional effect analysis of capacitance.

To achieve the above object, the present invention provides a power-saving and efficient driving method for driving a matrix of a plurality of LEDs arrayed in rows and columns, for enabling each row and column being driven with respect to the state thereof while each row being in a state selected from the group consisting of active and non-active and each column being in a state selected from the group consisting of active and non-active, the method comprising the steps of:

(A) executing the phases of Dis-Charge, Pre-Charge, Current On and Dis-Charge in successive for an active column;

(B) executing the phases of Dis-Charge, Floating, Dis-Charge and Dis-Charge in successive for a non-active column;

(C) executing the phases of Current Sink, Current Sink, Current Sink and Current Sink in successive for an active row; and (D) executing the phases of Floating, Floating, Reverse Bias and Floating in successive for a non-active row.

In a preferred embodiment of the invention, each state comprises four phases while the phases of step (A), (B) and (C) each last a comparably shorter period and the phases of step (D) each last a comparably longer period.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 4 illustrates respectively the phases of an active column, the phases of a non-active column, the phases of an active row and the phases of a non-active row according to the present invention.

DESCRIPTION OF THE PREFERRED EMBODIMENT

For your esteemed members of reviewing committee to further understand and recognize the fulfilled functions and structural characteristics of the invention, several preferable embodiments cooperating with detailed description are presented as the follows.

Please refer to FIG. 4, which illustrates respectively the phases of an active column, the phases of a non-active column, the phases of an active row and the phases of a non-active row according to the present invention. The method is primarily being applied for driving electro luminescence (El), however, the method of the present invention can also be applied for driving LEDs, OLEDs and the like. As seen in FIG. 4, the major characteristic of the invention is to use an improved four-phase driving method to replace the conventional three-phase driving method, in which the newly added Floating phase helps to improve the efficiency of other phases and can reduce power consumption.

The present invention provides a power-saving and efficient driving method for driving a matrix of a plurality of LEDs arrayed in rows and columns, for enabling each row and column being driven with respect to the state thereof while each row being in a state selected from the group consisting of active and non-active and each column being in a state selected from the group consisting of active and non-active, moreover, each state comprises four phases while the phases of step (A), (B) and (C) each last a comparably shorter period and the phases of step (D) each last a comparably longer period. The method comprises the steps of:

(A) executing the phases of Dis-Charge 51, Pre-Charge 52, Current On 53 and Dis-Charge 54 in successive for an active column;

(B) executing the phases of Dis-Charge 55, Floating 56, Dis-Charge 57 and Dis-Charge 58 in successive for a non-active column;

(C) executing the phases of Current Sink 59, Current Sink 60, Current Sink 61 and Current Sink 62 in successive for an active row; and (D) executing the phases of Floating 63, Floating 64, Reverse Bias 65 and Floating 66 in successive for a non-active row.

Figure 1A:
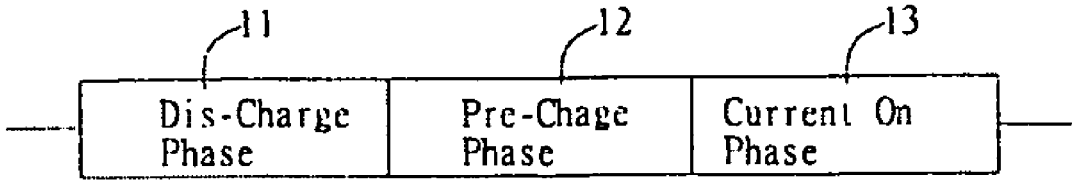
FIG.1A (PRIOR ART)
FIG. 1A illustrates the three phases for driving an active column of a conventional panel of passive-matrix LEDs.
Figure 1B:
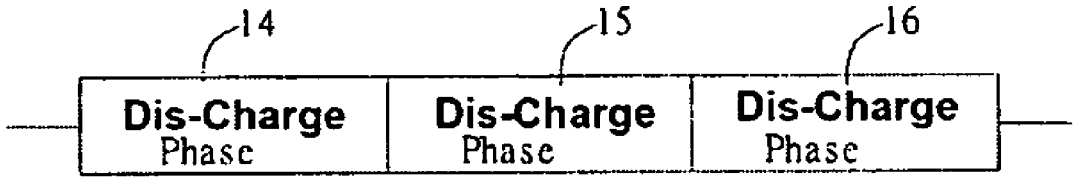
FIG.1B (PRIOR ART)
FIG. 1B illustrates the three phases for driving a non-active column of a conventional panel of passive-matrix LEDs.
Figure 1C:
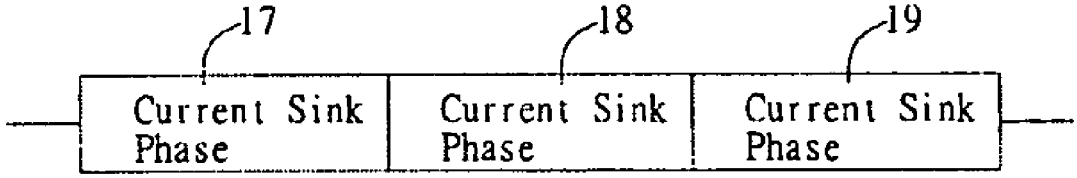
FIG.1C (PRIOR ART)
FIG. 1C illustrates the three phases for driving an active row of a conventional panel of passive-matrix LEDs.
Figure 1D:
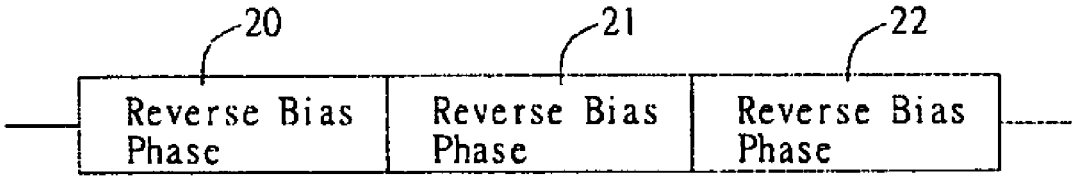
FIG.1D (PRIOR ART)
FIG. 1D illustrates the three phases for driving a non-active row of a conventional panel of passive-matrix LEDs.
Figure 2A:
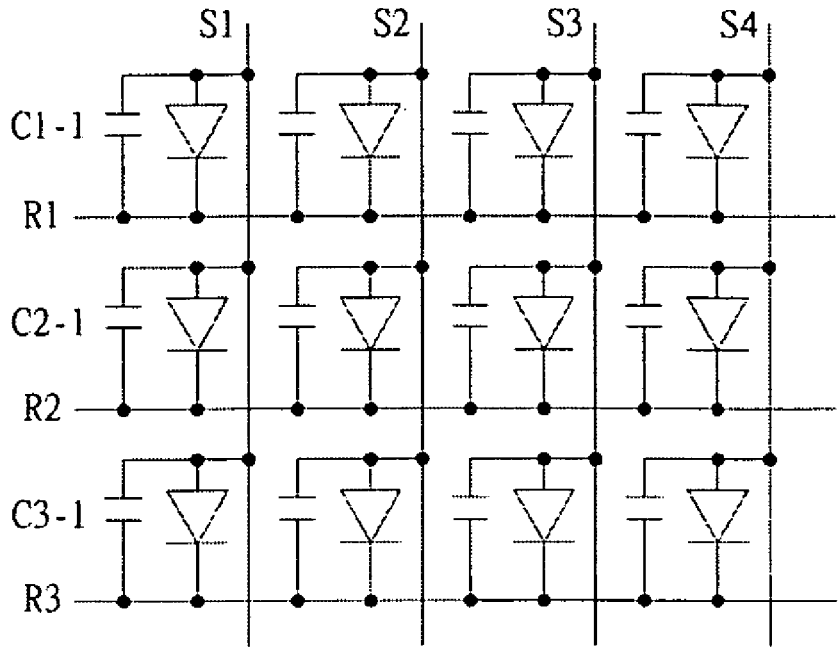
FIG.2A (PRIOR ART)
FIG. 2A is a schematic diagram showing a conventional panel of passive-matrix LEDs.
Figure 2B:
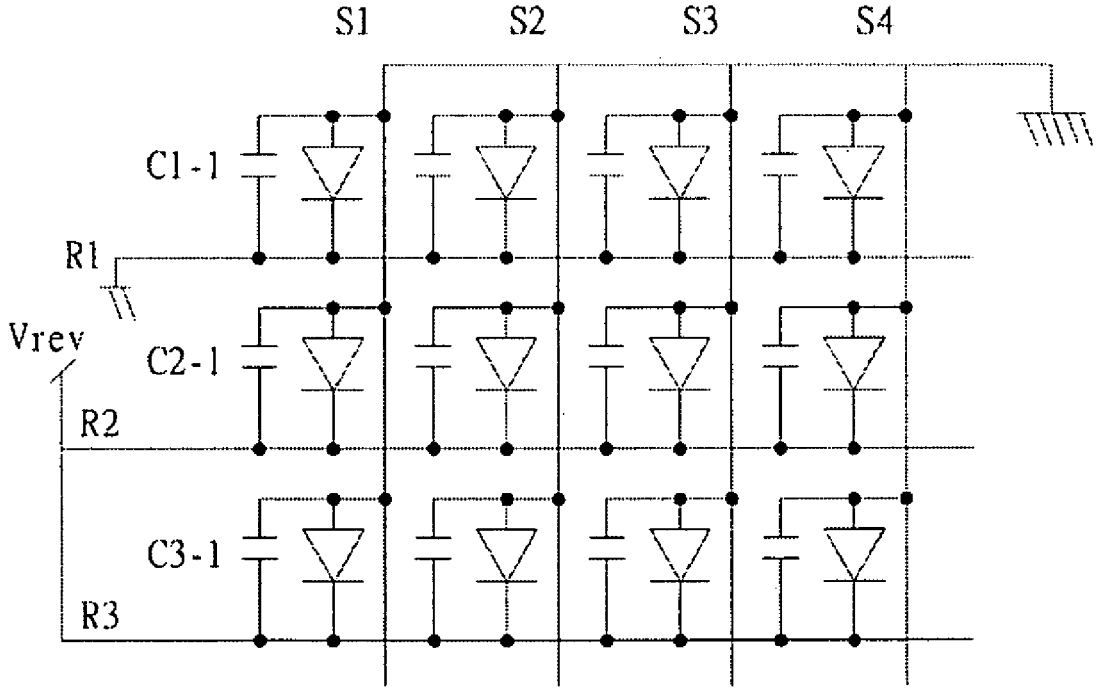
FIG.2B (PRIOR ART)
FIG. 2B is a schematic diagram showing a conventional panel of passive-matrix LEDs as the column S1 in the Dis-Charge phase during a scan duty.
Figure 2C:
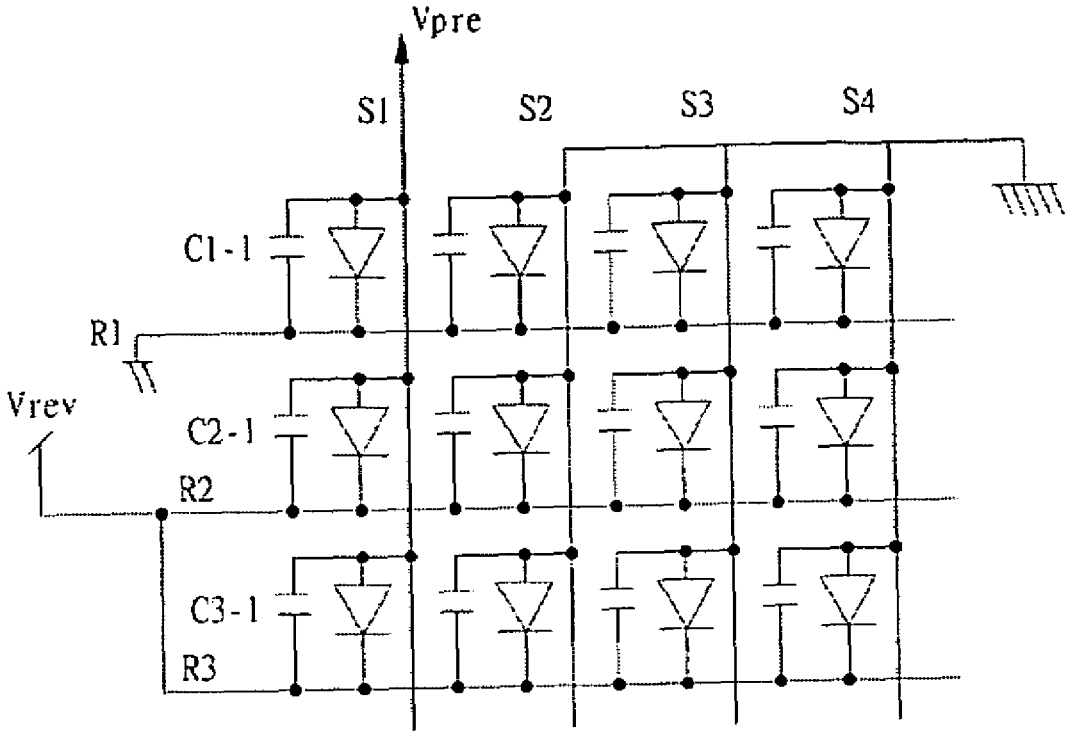
FIG.2C (PRIOR ART)
FIG. 2C is a schematic diagram showing a conventional panel of passive-matrix LEDs as the column S1 in the Pre-Charge phase during a scan duty.
Figure 2D:
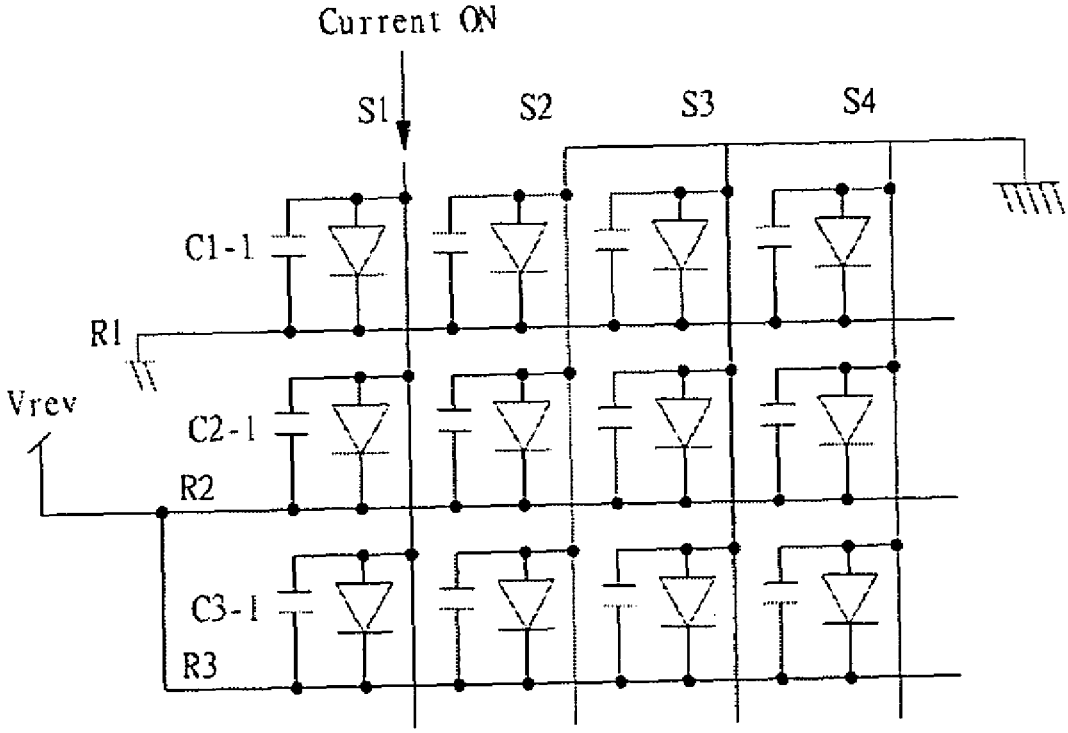
FIG.2D (PRIOR ART)
FIG. 2D is a schematic diagram showing a conventional panel of passive-matrix LEDs as the column S1 in the Current On phase during a scan duty.
Figure 5A:
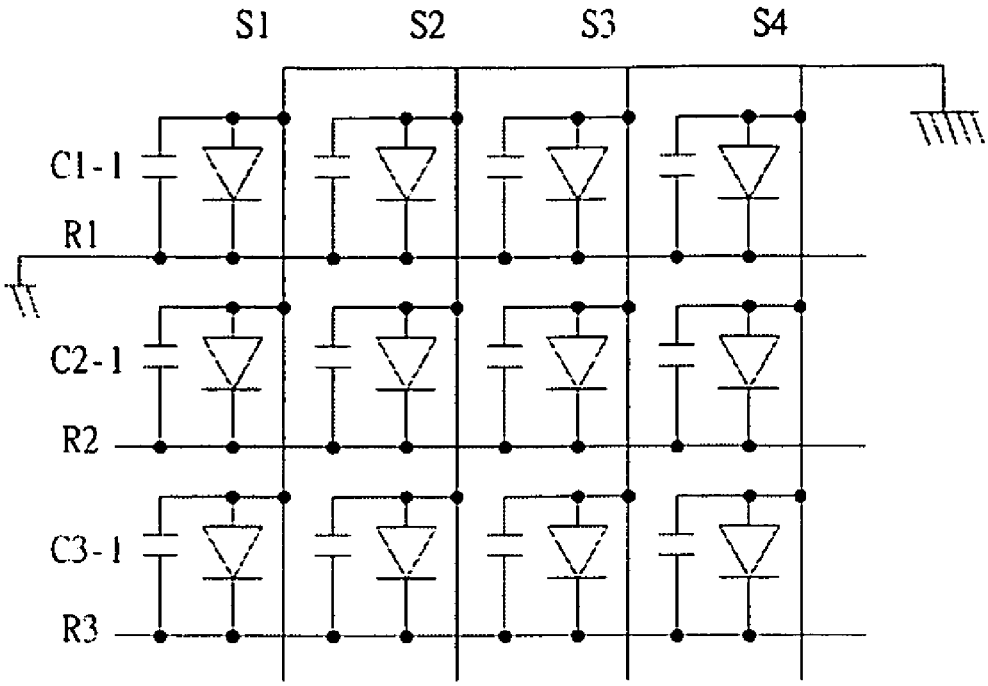
FIG. 5A is a schematic diagram showing a panel of passive-matrix LEDs as rows and columns thereof are all driven by their first phase according to the present invention.

In FIG. 5A, which is similar to that shown in FIG. 2A, as the panel of passive-matrix LEDs is first activated, the driver drives the passive-matrix LEDs to enter their first phase, i.e. the Dis-Charge phase 51 for the active columns and the Dis-Charge phase 55 for the non-active columns. For the active column, the phases to be executed successive thereto are the Pre-Charge phase 52, the Current On phase 53 and the Discharge phase 54 which is addition to the prior art shown in FIG. 1A. For the non-active column, the phases to be executed successive thereto are the Floating phase 56, the Dis-Charge phase 57 and the Discharge phase 58 that the Floating phase 56 is added to the phases of the prior art shown in FIG. 1B so as to prevent the reverse potential Vrev from charging the LEDs connected thereto and thus save power consumption.

Figure 5B:
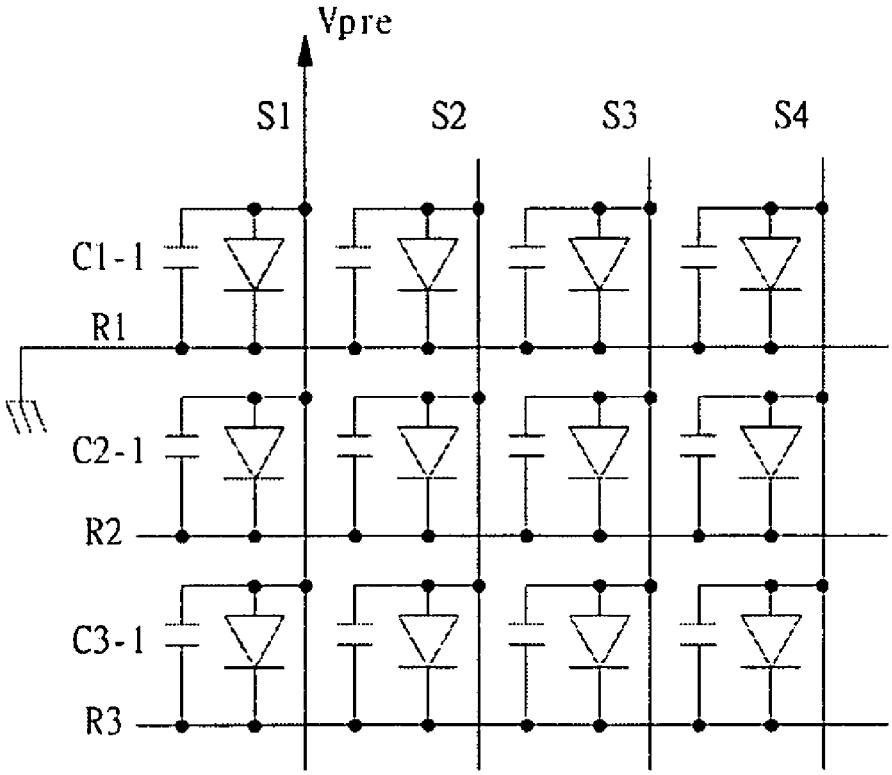
FIG. 5B is a schematic diagram showing a panel of passive-matrix LEDs as rows and columns thereof are all driven by their second phase according to the present invention.

Assuming that the column S1 is active, the columns S2, S3 and S4 are non-actives, the row R1 is active and the rows R2, R3 are non-active while all are driven to enter their second phase as shown in FIG. 5B, the Vpre will only charge the C1-1 since the columns S2, S3, S4 and the rows R2, R3 are all in the Floating phase thereof, that is, the Vpre will not be used to charge any LEDs not supposed to be charged and thus no power is wasted.

Figure 3A:
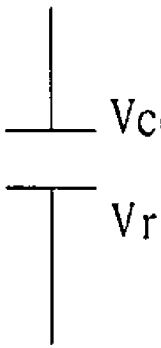
FIG. 3A (PRIOR ART)
FIG. 3A illustrates a capacitor of a conventional panel of passive-matrix LEDs as the capacitor is in the initial status of the Current On phase of FIG. 2D.
Figure 3B:
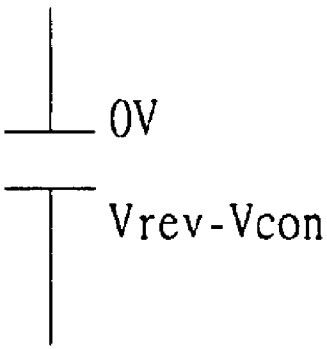
FIG. 3B (PRIOR ART)
FIG. 3B illustrates a capacitor of a conventional panel of passive-matrix LEDs as the capacitor is in the second status of the Current On phase of FIG. 2D while Vcon<=Vrev.
Figure 3C:
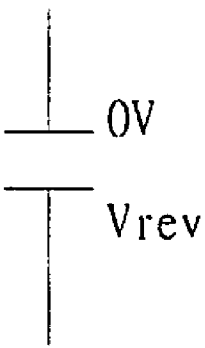
FIG. 3C (PRIOR ART)
FIG. 3C illustrates a capacitor of a conventional panel of passive-matrix LEDs as the capacitor is in the third status of the Current On phase of FIG. 2D after discharging.
Figure 5C:
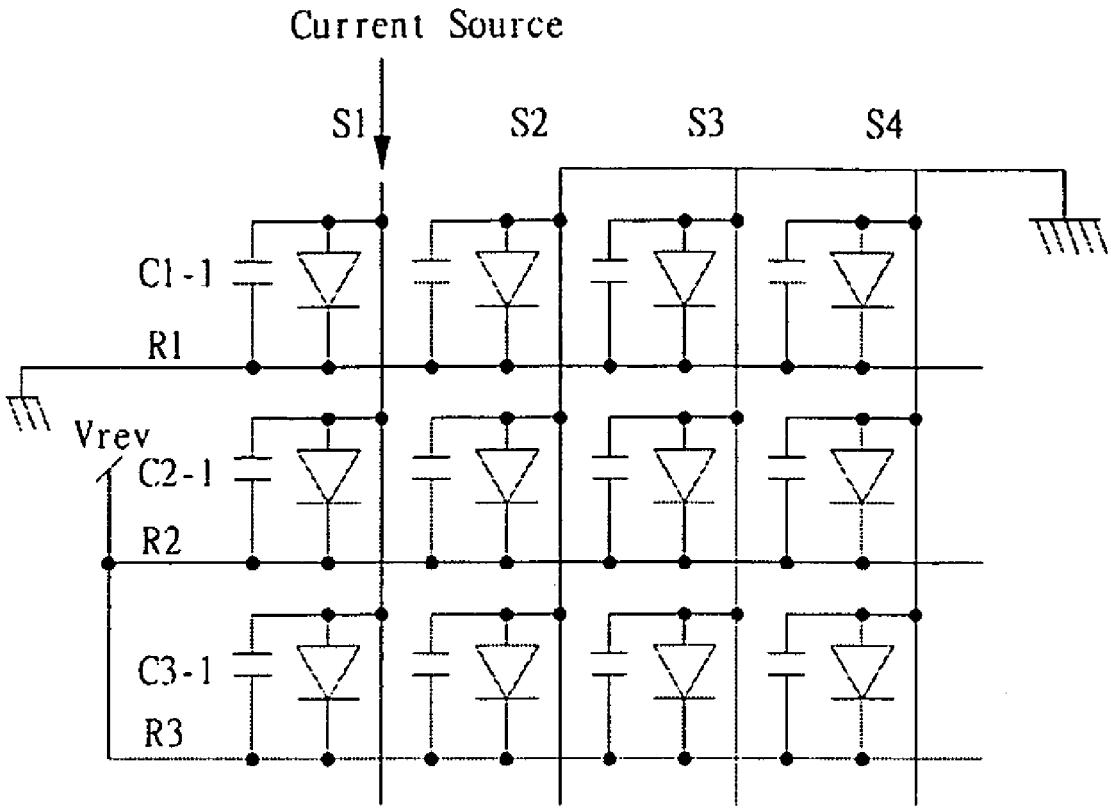
FIG. 5C is a schematic diagram showing a panel of passive-matrix LEDs as rows and columns thereof are all driven by their third phase according to the present invention.
Figure 5D:
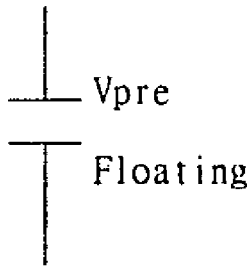
FIG. 5D illustrates the state of C2-1 and C3-1 before entering the Current On phase.
Figure 5E:
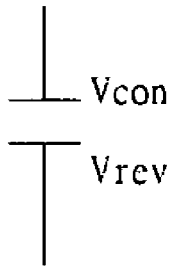
FIG. 5E illustrates the state of C2-1 and C3-1 after entering the Current On phase.
Figure 5F:
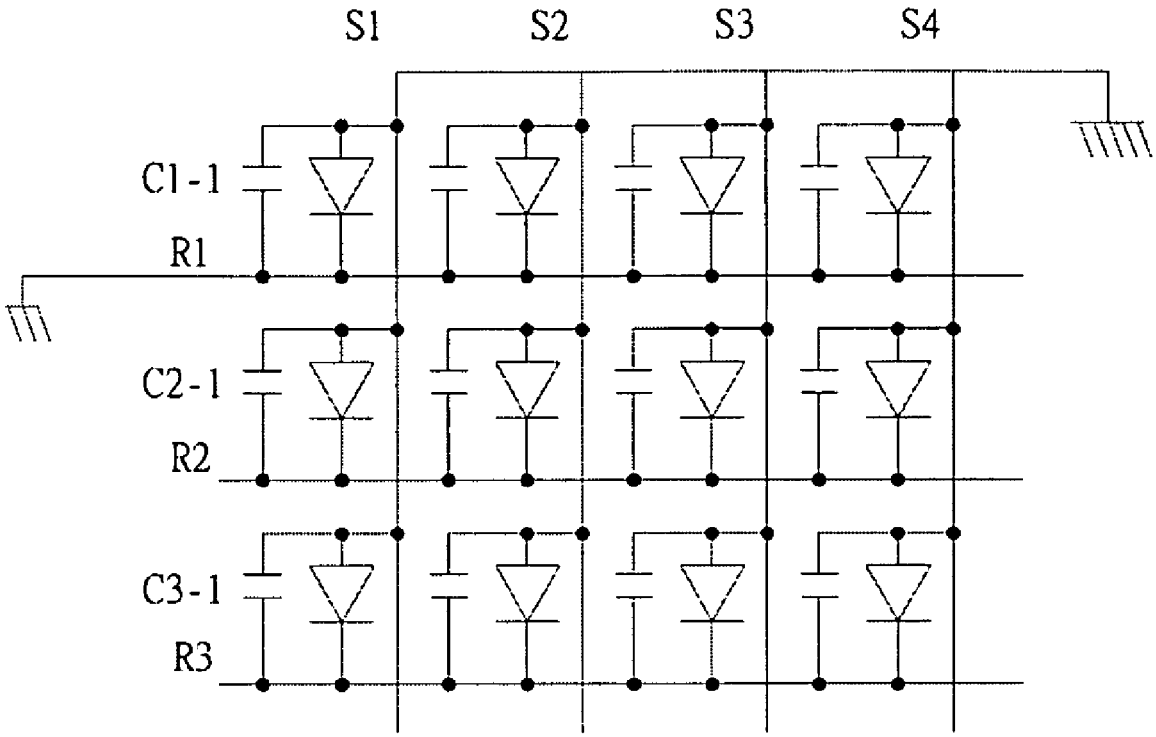
FIG. 5F is a schematic diagram showing a panel of passive-matrix LEDs as rows and columns thereof are all driven by their fourth phase according to the present invention.

As the column S1 enters the Current On phase as shown in FIG. 5C, the column S1 acting as an active column is connect to a current source while the columns S2, S3 and S4 are grounded, the row R1 acting an active row is still in its third phase, i.e. Current Sink, and the rows R2, R3 are connected to the reverse potential Vrev. As seen in FIG. 5D and FIG. 5E, since the R2 end of the C2-1 and the R3 end of the C3-1 are connect to Vrev, the voltages of both the S1 ends thereof are raised by the charge pump effect and thus the time required to raise current is shorten such that the luminance efficiency of the LED is increased. By virtue of this, as seen in FIG. 5E, since the value of Vcon is almost as large as that of Vrev, the amount of electricity need to be charged in the capacitors is (Vrev-Vcon), which is minimal, such that the prior-art surplus potential required to be charged and discharged as seen in FIG. 3A~FIG. 3C is far larger that that shown in FIG. 5E. Thus, it is noted that the cooperation of Current On phase and the Reverse Bias phase causes less power to be waste on C2-1 and C3-1.

After the Current On phase 53 is completed, the column S1 enters the Dis-Charge phase 54 that the columns S1, S2, S3, S4 and the row R1 are grounded and the rows R2, R3 are Floating. As such, the voltages of the C2-1 and C3-1 are no longer going to drop while the voltage of the column S1 is transferred from Vcon to 0 when grounding and thus are not required to be recharged to Vrev, which confirms again the present invention is more power-saving than prior arts.

From the above description, it is noted that the present invention can provide a power-saving and efficient driving method capable of optimizing the performance of a panel of passive-matrix LEDs by matching the phases of the corresponding rows and columns thereof as each row or column is selected to switch between the following phases: Dis-charge, Pre-Charge, Reverse Bias, Floating, Current On, and Current Sink according to the distributional effect analysis of capacitance.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A power-saving and efficient driving method for driving a matrix of light emitting diodes arrayed in rows and columns, and a Dis-Charge phase, a Pre-Charge phase, a Current-On phase, and a Floating phase are for each column, and a Current-Sink phase, the Floating phase, and a Reverse-Bias phase are for each row, the method comprising the steps of:

(A) executing the Dis-Charge phase for a first predetermined time, the Pre-Charge phase for a second predetermined time, the Current-On phase for a third predetermined time, and the Dis-Charge phase for a fourth predetermined time in successive for an active column;

(B) executing the Dis-Charge phase for the first predetermined time, the Floating phase for the second predetermined time, the Dis-Charge phase for the third predetermined time, and the Dis-Charge phase for the fourth predetermined time in successive for a non-active column;

(C) executing the Current-Sink phase for the first predetermined time, the Current-Sink phase for the second predetermined time, the Current-Sink phase for a third predetermined time, and the Current-Sink phase for the fourth predetermined time in successive for an active row; and (D) executing the Floating phase for a first predetermined time, the Floating phase for the second predetermined time, the Reverse-Bias phase for the third predetermined time, and the Floating phase in the fourth predetermined time in successive for a non-active row; and wherein the fourth predetermined time is longer than the first predetermined time, the second predetermined time, and the third predetermined time.

2. The method of claim 1, wherein the light emitting diode is an organic light emitting diode.

3. The method of claim 1, wherein the light emitting diode is an electro luminescence.

* * * * *